US007703365B2

(12) United States Patent
Wight et al.

(10) Patent No.: US 7,703,365 B2
(45) Date of Patent: Apr. 27, 2010

(54) LATERALLY MOVABLE TRIM SAW

(75) Inventors: Geoff Wight, Salmon Arm (CA); Ken Kantymir, Salmon Arm (CA); Deane Henderson, Salmon Arm (CA)

(73) Assignee: USNR/Kockums Cancar Company, Vancouver, WA (US)

( * ) Notice: Subject to any disclaimer, the term of this patent is extended or adjusted under 35 U.S.C. 154(b) by 955 days.

(21) Appl. No.: 11/030,052

(22) Filed: Jan. 7, 2005

(65) Prior Publication Data

US 2005/0150341 A1 Jul. 14, 2005

Related U.S. Application Data

(60) Provisional application No. 60/534,698, filed on Jan. 8, 2004.

(51) Int. Cl.
*B27B 5/00* (2006.01)

(52) U.S. Cl. ..... 83/471.1; 83/498; 83/508.1; 83/508.2; 83/482

(58) Field of Classification Search ..... 83/368, 83/508.1–508.3, 504, 471.1, 471.2, 479, 83/482, 491, 498
See application file for complete search history.

(56) References Cited

U.S. PATENT DOCUMENTS 1,461,919 A * 7/1923 La Malta ..... 83/409
2,641,288 A * 6/1953 Blickenderfer, Jr. et al. ... 83/368
2,961,015 A * 11/1960 Randall ..... 83/508.3
3,036,605 A * 5/1962 Joa ..... 83/354
3,176,566 A * 4/1965 Patterson, Jr. ..... 83/348
4,922,780 A * 5/1990 Hurdle, Jr. ..... 83/508.3
4,960,023 A * 10/1990 Reuter et al. ..... 83/368
5,142,955 A 9/1992 Hale
6,526,856 B2 * 3/2003 Newnes ..... 83/423
6,543,498 B1 * 4/2003 Woodham ..... 144/379
6,631,662 B2 * 10/2003 Akram et al. ..... 83/495
6,705,190 B2 * 3/2004 Newnes et al. ..... 83/75.5
7,025,251 B2 * 4/2006 Woodham ..... 234/38
7,040,207 B2 * 5/2006 Lindenblatt ..... 83/508.1

* cited by examiner

*Primary Examiner*—Boyer D Ashley
*Assistant Examiner*—Omar Flores-Sánchez
(74) *Attorney, Agent, or Firm*—Schwabe, Williamson & Wyatt

(57) ABSTRACT

A lumber trimmer is disclosed wherein only one pair of parallel spaced-apart trim saws is mounted at one or both ends of a shaft. Each pair of trim saws is laterally movable along the shaft parallel to the longitudinal axis of lumber in the lumber trimmer. Each saw of the pair of trim saws is operably coupled with an actuator such that each saw is selectively vertically movable to trim the lumber. The pair of trim saws may be mounted to a carriage. A second actuator is operably coupled with the pair of trim saws for selectively laterally translating the pair of trim saws along the shaft.

27 Claims, 3 Drawing Sheets

LATERALLY MOVABLE TRIM SAW

CROSS REFERENCE TO RELATED APPLICATION

This application claims priority from U.S. Provisional Patent Application No. 60/534,698 filed Jan. 8, 2004 entitled Laterally Movable Trim Saw.

FIELD OF THE INVENTION

This invention relates to the field of lumber trimmers, and in particular to vertically and laterally translatable trim saws.

BACKGROUND OF THE INVENTION

A lumber trimmer contains multiple, independently vertically actuable drop saws used to cut lumber into a variety of lengths. The drop saws are fixed in their position along the trimmer. One movable trim saw may be mounted at or near one end of the trimmer. The movable trim saw is vertically and horizontally actuable to trim an end of a board as it passes through the trimmer. In particular, the movable trim saw is a single circular saw that is horizontally incrementally movable so as to trim the end of a board at a point closest to the desired increment. Where the single movable trim saw may be translated laterally over a distance of for example 24 inches, it will be appreciated that the time interval to move the saw from a minimum first end trim (that is, trimming only a small amount off the end of the board) to a second maximum end trim (in the given example ten trimming twenty-four inches off the end of the board) may be relatively lengthy compared to the available time between boards in light of lug speeds approaching 200 lugs per minute typically experienced in conventional lumber handling chain conveyors.

In the prior art applicant is aware of U.S. Pat. No. 5,142,955 which issued Sep. 1, 1992, to Hale for a Lumber Cutter for Removing End Defects and Sawing to Desired Lengths. This application discloses a unitary drop trim saw mounted at the root edge of a lumber conveyor. The drop trim saw may be selectively vertically articulated into or out of the path of lumber carried by the conveyor. The trim saw is horizontally slidable into the lumber path in ½ inch increments over a 24 inch distance, in order to cut defects from the end of a board.

The present invention includes selective lateral translation of a pair of independently actuable end trim saws, mounted for concurrent co-axial transverse reciprocal movement at the end of a trimmer, thus minimizing the horizontal translation distance of the saws from a first minimum trimming position to a second maximum trimming position. The time required for lateral translation between these two positions is thereby reduced, which increases efficiency, for example by avoiding a reduction in lumber handling speeds.

In the current invention, the trim saws has a fixed spacing between them of, for example, 12 1/16 inches, and are vertically actuable by suitable pneumatic means so as to selectively cut lumber to the desired length as it passes through the trimmer. For example, when cutting a 16-foot board, the most valuable use is to cut it into custom stud lengths, such as 92⅝ inches. Using trim saws of fixed spacing, two 8-foot boards are normally produced as the larger board passes through the trimmer. A stud is produced at the 'lumber' line end of the trimmer where a movable precision end trim saw is employed. The 8-foot (96 inch) length remaining on the opposite 'clear' line end remains as a dimensioned lumber piece unless further trimming is available. The substitution of the last two saws in a 16-foot trimmer with a pair of laterally movable trim saws, such as those of the present invention, allows for greater flexibility in the lumber trimming process. In sawmills where metric and other lumber sizes are produced, laterally movable trim saws provide ease of trimming to the required length.

It is therefore an object of the present invention to provide a lumber trimmer with at least one pair of laterally movable, independently actuable trim saws positioned at one or both ends of the trimmer to facilitate additional trimming of the lumber.

It is a further object of the present invention to provide a lumber trimmer which can produce a variety of lumber lengths irrespective of the fixed trim saw spacing.

SUMMARY OF THE INVENTION

The present invention is a lumber trimmer having one or more pairs of trim saws which are positioned at an end of the trimmer and which are laterally movable relative to the flow path of the boards, that is, movable parallel to the longitudinal axis of boards translating through the trimmer. Each trim saw of the pair of trim saws is a drop saw which is selectively vertically movable to drop down to trim the end of a board. Without intending to be limiting, where a pair of such movable trim saws are employed they may be mounted to a carriage a fixed distance spaced apart, for example 12 1/16 inches, and are laterally actuable by a hydraulic actuator or other suitable means for example by acting on the carriage. The end trim saws are thus reciprocally and concurrently movable and provide precise non-incremental board end trimming.

By way of example, by utilizing a laterally extending 12 inch hydraulic actuator where the pair of trim saws is laterally separated by approximately 12 inches, precision trimming can be undertaken over a lateral distance of approximately 2 feet. Where, in a series of boards passing through a trimmer, a first board has been trimmed by the outward trim saw 3 inches from a zero lumber line and the following second board in that series must be trimmed 18 inches from the zero lumber line, the pair of trim saws need only be advanced a further 3 inches following trimming of the first board so as to trim the second board.

Alternatively, each saw may be independently laterally movable, for example movable on the carriage, by separate actuators. Suitable motion control sensors positioned upstream from the trim saws normally govern the actuation of the hydraulic actuator and operation of the trim saws.

The supporting frame for supporting the movable trim saws can be preferably mounted to the trimmer carriage at the 'clear' end, or alternatively at both ends of the trimmer. A pair of parallel rods may be provided which pass through linear bearings on which the trim saws are mounted. A pneumatic actuator mounted to the frame of the trimmer reciprocally moves the saw pair in unison with respect to the end of the board to be trimmed. Pneumatic actuators mounted in proximity to each saw, and laterally movable in concert with the saws, provide for independent vertical actuation of each trim saw.

In summary, the trimmer according to the present invention for cutting a workpiece may be characterized in one aspect as including a frame supporting a lateral translation means across a workpiece flow path and no more than a first pair of trim saws mounted at a first end of the trimmer in a parallel spaced apart orientation on the lateral translation means. The first pair of trim saws are laterally translatable on the lateral translation means substantially parallel to a longitudinal axis of the workpiece. A first pair of vertical actuators are provided for selectively independently vertically displacing each trim saw of the first pair of trim saws between a raised position and a lowered position. Each vertical actuator cooperates with a corresponding trim saw, whereby each trim saw may be selectively lowered to engage and trim the workpiece. A selectively actuable first lateral actuator cooperates with the lateral translation means for laterally translating the first pair of trim saws reciprocally and concurrently laterally across a workpiece flow path such that a lateral translation distance of the first pair of trim saws is minimized when positioning a first trim saw or a second trim saw of the first pair of trim saws for trimming the workpiece.

In one embodiment the lateral translation means includes a laterally oriented horizontal first shaft. The lateral actuator is operably coupled to the first pair of trim saws and adapted for selectively horizontally translating the first pair of trim saws non-incrementally along the first shaft substantially parallel to the longitudinal axis of the workpiece.

The first pair of trim saws may be mounted on a carriage, and the carriage mounted on the first shaft operably coupled to the lateral actuator such that the carriage is selectively laterally movable to reciprocally position the first pair of trim saws relative to the workpiece. Each trim saw may be mounted on a bell-crank. Each vertical actuator cooperates with a corresponding bell-crank. In one embodiment the first shaft includes at least a pair of parallel shafts.

Each of the bell-cranks may include an upper arm and a lower arm. The first trim saw is rotatably mounted on the lower arm of a first bell-crank and a second trim saw is rotatably mounted on the lower arm of a second bell-crank. A first vertical actuator is mounted to the upper arm of the first bell-crank and a second vertical actuator is mounted to the upper arm of the second bell-crank.

In one embodiment, the lateral actuator includes two actuators, each operably coupled with a corresponding trim saw of the first and the second trim saws such that the first and the second trim saws may be independently selectively laterally translated on the lateral translation means.

In a further embodiment no more than a second pair of trim saws are mounted in a parallel spaced apart orientation on the lateral translation means at a second end of the trimmer opposite the first end of the trimmer. The second pair of trim saws are laterally translatable on the lateral translation means substantially parallel to the longitudinal axis of the workpiece. Similar to the first pair of trim saws, a second pair of vertical actuators are provided for selectively vertically independently displacing each trim saw of the second pair of trim saws between a raised position out of the workpiece flow path and a lowered position in the workpiece flow path. A selectively actuable second lateral actuator cooperating with the lateral translation means for laterally translating the second pair of trim saws reciprocally and concurrently laterally across a workpiece flow path such that a lateral translation distance of the second pair of trim saws is minimized when positioning a first trim saw or a second trim saw of the second pair of trim saws for trimming the workpiece. The lateral translation means may include a laterally oriented horizontal second shaft. The second pair of trim saws may be mounted on the second shaft.

DETAILED DESCRIPTION OF EMBODIMENTS OF THE INVENTION

Figure 1:
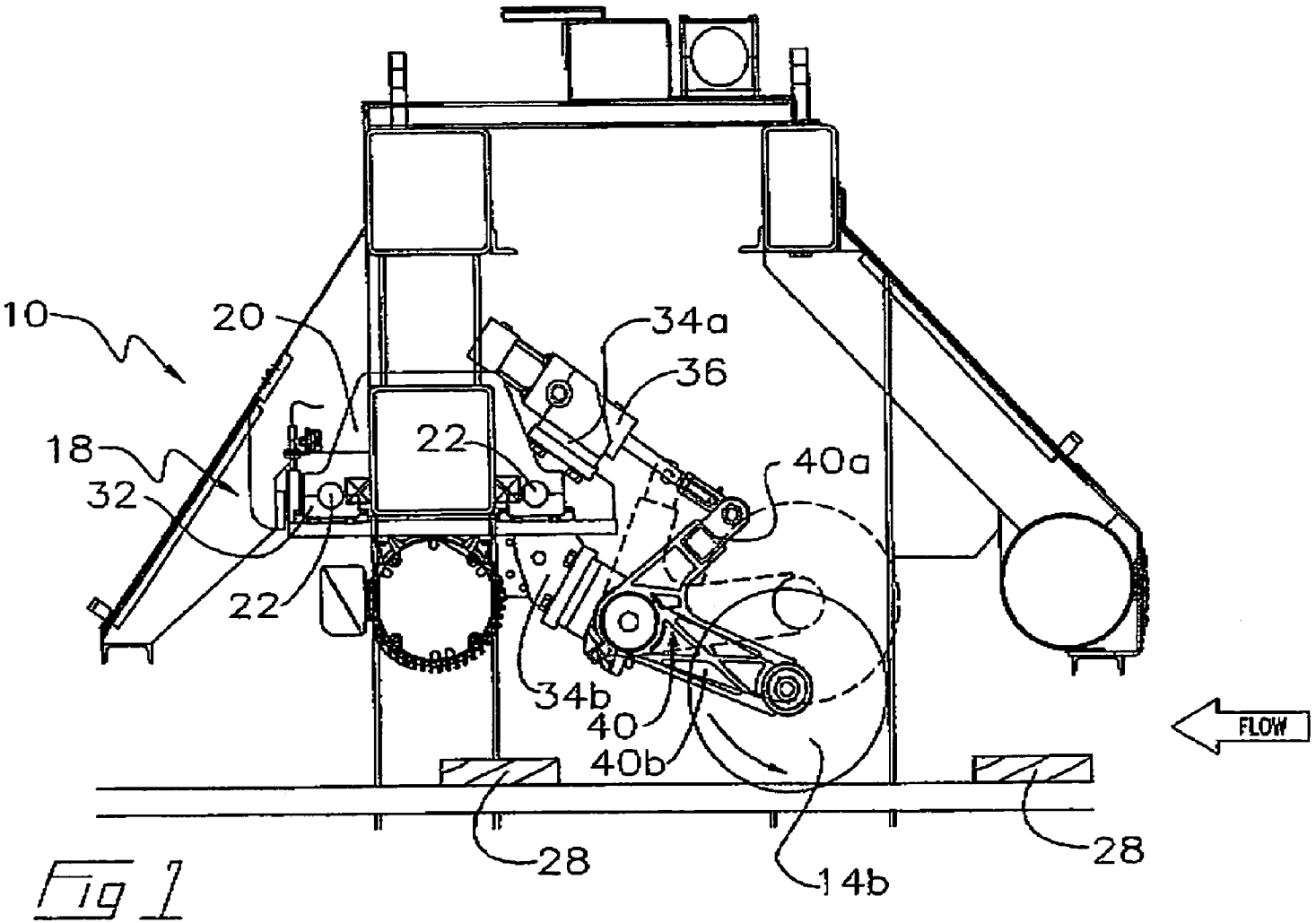
FIG. 1 is a side elevation view of a lumber trimmer according to the present invention.

With reference to the drawing FIGS. 1-4, wherein similar characters of reference denote corresponding parts in each view, a trimmer 10, which by way of example has the capacity to accommodate boards of 16 feet in length, has at an end 12, that is the 'clear' line end, trim saws 14*a* and 14*b* which are mounted on a carriage 18. Carriage 18 is laterally movable on a pair of parallel guide shafts 22 through the action of linear actuator 26 to reciprocally position trim saws 14*a* and 14*b* in relation to board 28 for desired length trimming. End brackets 20 are rigidly mounted to the frame of trimmer 10 and support both guide shafts 22 and carriage 18.

Linear bearings 32 mounted on guide shafts 22 support upper and lower mounting brackets 34*a* and 34*b*, respectively. A pneumatic linear actuator 36 is mounted to each upper bracket 34*a*. An "L"-shaped or for example a generally "V" shaped yoke 40 is pivotally mounted to each lower mounting bracket 34*b*. Yoke 40 is a bell-crank oriented with its upper arm 40*a* and lower arm 40*b* in a vertical plane and pivotable about the intersection between the upper and lower arms. Actuator 36 is connected to, and operates on, the upper end of upper arm 40*a*. A trim saw 14 is rotatably mounted to the distal end of lower arm 40*b*. Trim saws 14*a* and 14*b* may thus be independently lowered into a trimming position to trim board 28, as board 28 translates in the direction of flow, by actuation of the corresponding actuator 36, or alternatively raised to let board 28 pass through the trimmer untrimmed by a particular trim saw.

Figure 2:
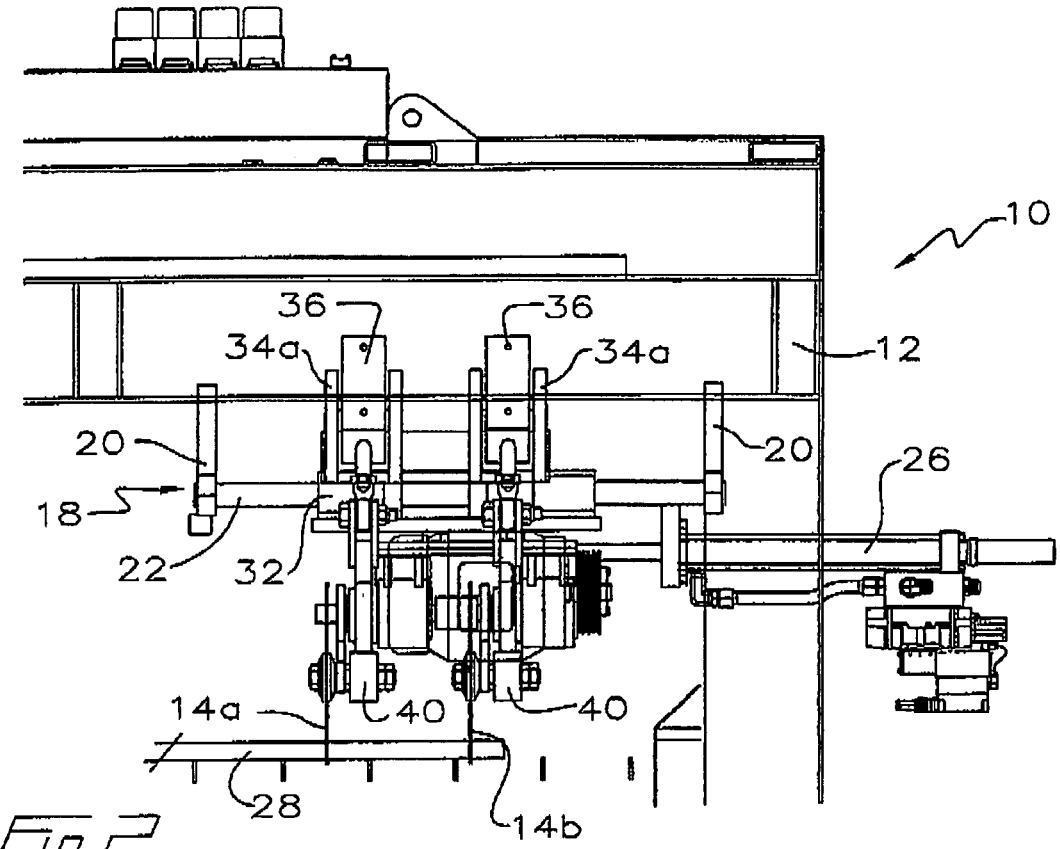
FIG. 2 is a front elevation view of the laterally movable trim saws of the present invention.
Figure 3:
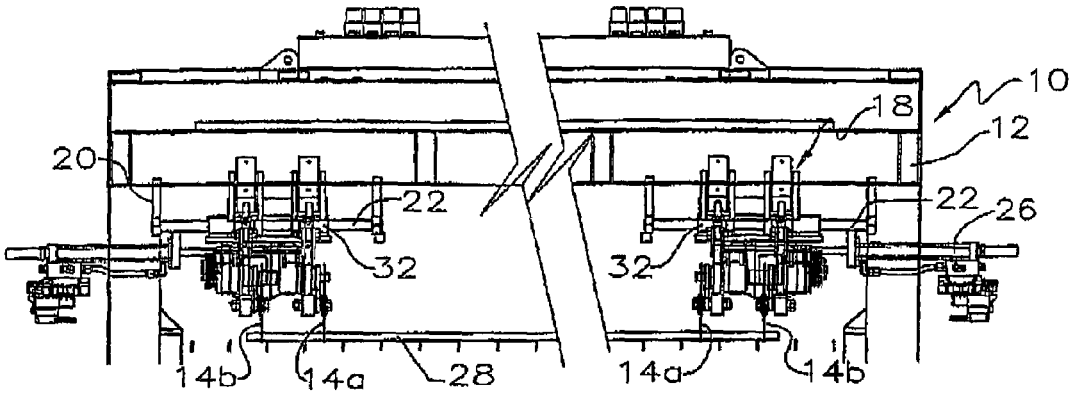
FIG. 3 is a front elevation view of the laterally movable trim saws of an alternative embodiment of the present invention.

Linear actuator 26 may be selectively actuated to cooperatively laterally translate trim saws 14*a* and 14*b* with respect to the end 28*a* to be trimmed off board 28. In the embodiment of FIG. 2, only one pair of trim saws 14*a* and 14*b* are mounted only at one end of the trimmer (the example being the clear line end). In the embodiment of FIG. 3, two pairs of trim saws 14*a* and 14*b* are mounted on their corresponding carriages 18, one at each end of the trimmer.

Figure 4:
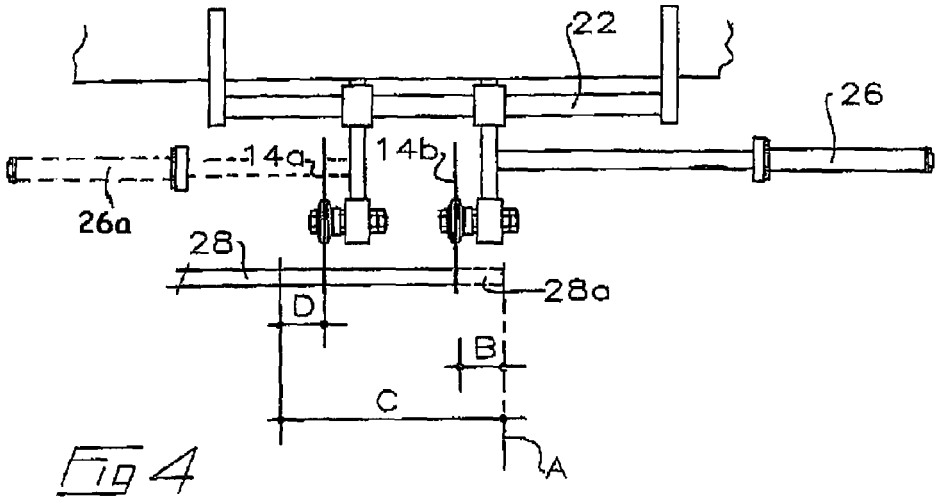
FIG. 4 is a schematic view illustrating successive trimming operations by the trim saws of the present invention.

In one example, not intending to be limiting, which may be applied to the simplified view of FIG. 4, actuator 26 is a 12-inch actuator and trim saws 14*a* and 14*b* are spaced approximately 12 inches apart, non-incremental trimming is possible over a 24-inch distance. For example, if end 28*a* of board 28 is to be trimmed a distance B, equal to 3 inches in the current example, from zero lumber line "A", the pair of trim saws need be advanced by distance B and the outward trim saw 14*b* saw dropped to trim board 28, while maintaining trim saw 14*a* raised. Where the succeeding or next adjacent board in a sequential series of boards 28 to be trimmed is required to be trimmed a distance C, equal to 18 inches in the current example, from zero lumber line A, the pair of trim saws need only be advanced by distance D of 3 inches, and inward trim saw 14*a* lowered to trim board 28, thereby minimizing the time required to selectively reposition the trim saws.

In an alternative embodiment of the present invention, each trim saw on each pair of trim saws 14 may be independently laterally movable relative to one another by the inclusion of a second linear actuator. Thus each trim saw may be independently laterally translated by its own corresponding linear actuator 26*a* (shown in dotted outline in FIG. 4).

As will be apparent to those skilled in the art in the light of the foregoing disclosure, many alterations and modifications are possible in the practice of this invention without departing from the spirit or scope thereof.

What is claimed is:

1. A trimmer for cutting an ended workpiece ended on a transfer upstream of the trimmer, the trimmer comprising:

a frame supporting a lateral translation means across a workpiece flow path;

no more than a first pair of trim saws mounted at a first end of the trimmer in a parallel spaced apart orientation on said lateral translation means, said first pair of trim saws laterally translatable on said lateral translation means substantially parallel to a longitudinal axis of the workpiece; and a first pair of vertical actuators for selectively independently vertically displacing each trim saw of said first pair of trim saws between a raised position and a lowered position, each vertical actuator of said pair of vertical actuators cooperating with a corresponding trim saw of said first pair of trim saws, whereby each said trim saw of said first pair of trim saws may be selectively lowered to engage and trim the workpiece;

a selectively actuable first lateral actuator cooperating with said lateral translation means for laterally translating said first pair of trim saws reciprocally and concurrently laterally across a workpiece flow path such that a lateral translation distance of said first pair of trim saws is minimized when positioning a first trim saw or a second trim saw of said first pair of trim saws for trimming the workpiece, wherein said lateral translation means includes a laterally oriented horizontal first shaft, and wherein said first shaft comprises at least a pair of parallel shafts.

2. The trimmer of claim 1 wherein said lateral actuator is operably coupled to said first pair of trim saws and adapted for selectively horizontally translating said first pair of trim saws non-incrementally along said first shaft substantially parallel to the longitudinal axis of the workpiece.

3. The trimmer of claim 2 wherein said first pair of trim saws is mounted on a carriage, and wherein said carriage is mounted on said first shaft and is operably coupled to said lateral actuator such that said carriage is selectively laterally movable to reciprocally position said first pair of trim saws relative to the workpiece.

4. The trimmer of claim 1 wherein said lateral actuator includes two actuators, each operably coupled with a corresponding trim saw of said first and said second trim saws such that said first and said second trim saws may be independently selectively laterally translated on said lateral translation means.

5. The trimmer of claim 1 further comprising:

no more than a second pair of trim saws mounted in a parallel spaced apart orientation on said lateral translation means at a second end of the trimmer opposite said first end, said second pair of trim saws laterally translatable on said lateral translation means substantially parallel to said longitudinal axis of the workpiece; and a second pair of vertical actuators for selectively vertically independently displacing each trim saw of said second pair of trim saws between a raised position out of said workpiece flow path and a lowered position in said workpiece flow path;

a selectively actuable second lateral actuator cooperating with said lateral translation means for laterally translating said second pair of trim saws reciprocally and concurrently laterally across a workpiece flow path such that a lateral translation distance of said second pair of trim saws is minimized when positioning a first trim saw or a second trim saw of said second pair of trim saws for trimming the workpiece.

6. The trimmer of claim 5 wherein said lateral translation means includes a laterally oriented horizontal second shaft, and said second pair of trim saws are mounted on said second shaft.

7. The trimmer of claim 1 further comprising:

no more than a second pair of trim saws mounted in a parallel spaced apart orientation on said lateral translation means at a second end of the trimmer opposite said first end, said second pair of trim saws laterally translatable on said lateral translation means substantially parallel to said longitudinal axis of the workpiece; and a second pair of vertical actuators for selectively vertically independently displacing each trim saw of said second pair of trim saws between a raised position out of said workpiece flow path and a lowered position in said workpiece flow path;

a selectively actuable second lateral actuator cooperating with said lateral translation means for laterally translating said second pair of trim saws reciprocally and concurrently laterally across a workpiece flow path such that a lateral translation distance of said second pair of trim saws is minimized when positioning a second trim saw or a second trim saw of said second pair of trim saws for trimming the workpiece.

8. The trimmer of claim 7 wherein said lateral translation means includes a laterally oriented horizontal second shaft, and said second pair of trim saws are mounted on said second shaft.

9. A trimmer for cutting an ended workpiece ended on a transfer upstream of the trimmer, the trimmer comprising:

a frame supporting a lateral translation means across a workpiece flow path, wherein said lateral translation means includes a laterally oriented horizontal first shaft, and wherein said first shaft comprises at least a pair of parallel shafts;

no more than a first pair of trim saws mounted at a first end of the trimmer in a parallel spaced apart orientation on said lateral translation means, said first pair of trim saws laterally translatable on said lateral translation means substantially parallel to a longitudinal axis of the workpiece; and a first pair of vertical actuators for selectively independently vertically displacing each trim saw of said first pair of trim saws between a raised position and a lowered position, each vertical actuator of said pair of vertical actuators cooperating with a corresponding trim saw of said first pair of trim saws, whereby each said trim saw of said first pair of trim saws may be selectively lowered to engage and trim the workpiece;

a selectively actuable first lateral actuator cooperating with said lateral translation means for laterally translating said first pair of trim saws reciprocally and concurrently laterally across a workpiece flow path such that a lateral translation distance of said first pair of trim saws is minimized when positioning a first trim saw or a second trim saw of said first pair of trim saws for trimming the workpieces;

wherein said lateral actuator includes two actuators, each operably coupled with a corresponding trim saw of said first and said second trim saws such that said first and said second trim saws may be independently selectively laterally translated on said lateral translation means.

10. The trimmer of claim 1 wherein said lateral actuator is operably coupled to said first pair of trim saws and adapted for selectively horizontally translating said first pair of trim saws non-incrementally along said first shaft substantially parallel to the longitudinal axis of the workpiece.

11. The trimmer of claim 10 wherein said first pair of trim saws is mounted on a carriage, and wherein said carriage is mounted on said first shaft and is operably coupled to said lateral actuator such that said carriage is selectively laterally movable to reciprocally position said first pair of trim saws relative to the workpiece.

12. The trimmer of claim 11 wherein each said trim saw is mounted on a bell-crank, and each said vertical actuator cooperates with a corresponding said bell-crank.

13. The trimmer of claim 12 wherein each said bell-cranks includes an upper arm and a lower arm, and wherein said first trim saw is rotatably mounted on said lower arm of a first bell-crank of said bell-cranks and said second trim saw is rotatably mounted on said lower arm of a second bell-crank of said bell-cranks.

14. The trimmer of claim 13 wherein said carriage further comprises bearings mounted on said first shaft.

15. The trimmer of claim 13 wherein a first vertical actuator of said vertical actuators is mounted to said upper arm of said first bell-crank and a second vertical actuator of said vertical actuators is mounted to said upper arm of said second bell-crank.

16. The trimmer of claim 1 further comprising:

no more than a second pair of trim saws mounted in a parallel spaced apart orientation on said lateral translation means at a second end of the trimmer opposite said first end, said second pair of trim saws laterally translatable on said lateral translation means substantially parallel to said longitudinal axis of the workpiece; and a second pair of vertical actuators for selectively vertically independently displacing each trim saw of said second pair of trim saws between a raised position out of said workpiece flow path and a lowered position in said workpiece flow path;

a selectively actuable second lateral actuator cooperating with said lateral translation means for laterally translating said second pair of trim saws reciprocally and concurrently laterally across a workpiece flow path such that a lateral translation distance of said second pair of trim saws is minimized when positioning a first trim saw or a second trim saw of said second pair of trim saws for trimming the workpiece.

17. The trimmer of claim 16 wherein said lateral translation means includes a laterally oriented horizontal second shaft, and said second pair of trim saws are mounted on said second shaft.

18. The trimmer of claim 15 further comprising:

no more than a second pair of trim saws mounted in a parallel spaced apart orientation on said lateral translation means at a second end of the trimmer opposite said first end, said second pair of trim saws laterally translatable on said lateral translation means substantially parallel to said longitudinal axis of the workpiece; and a second pair of vertical actuators for selectively vertically independently displacing each trim saw of said second pair of trim saws between a raised position out of said workpiece flow path and a lowered position in said workpiece flow path;

a selectively actuable second lateral actuator cooperating with said lateral translation means for laterally translating said second pair of trim saws reciprocally and concurrently laterally across a workpiece flow path such that a lateral translation distance of said second pair of trim saws is minimized when positioning a second trim saw or a second trim saw of said second pair of trim saws for trimming the workpiece.

19. The trimmer of claim 18 wherein said lateral translation means includes a laterally oriented horizontal second shaft, and said second pair of trim saws are mounted on said second shaft.

20. A trimmer for cutting an ended workpiece ended on a transfer upstream of the trimmer, the trimmer comprising:

a frame supporting a lateral translation means across a workpiece flow path;

no more than a first pair of trim saws mounted at a first end of the trimmer in a parallel spaced apart orientation on said lateral translation means, said first pair of trim saws laterally translatable on said lateral translation means substantially parallel to a longitudinal axis of the workpiece; and a first pair of vertical actuators for selectively independently vertically displacing each trim saw of said first pair of trim saws between a raised position and a lowered position, each vertical actuator of said pair of vertical actuators cooperating with a corresponding trim saw of said first pair of trim saws, whereby each said trim saw of said first pair of trim saws may be selectively lowered to engage and trim the workpiece;

a selectively actuable first lateral actuator cooperating with said lateral translation means for laterally translating said first pair of trim saws reciprocally and concurrently laterally across a workpiece flow path such that a lateral translation distance of said first pair of trim saws is minimized when positioning a first trim saw or a second trim saw of said first pair of trim saws for trimming the workpiece, wherein said lateral translation means includes a laterally oriented horizontal first shaft, wherein said lateral actuator is operably coupled to said first pair of trim saws and adapted for selectively horizontally translating said first pair of trim saws non-incrementally along said first shaft substantially parallel to the longitudinal axis of the workpiece, wherein said first pair of trim saws is mounted on a carriage, and wherein said carriage is mounted on said first shaft and is operably coupled to said lateral actuator such that said carriage is selectively laterally movable to reciprocally position said first pair of trim saws relative to the workpiece, wherein each said trim saw is mounted on a bell-crank, and each said vertical actuator cooperates with a corresponding said bell-crank, and wherein said first shaft comprises at least a pair of parallel shafts.

21. The trimmer of claim 20 wherein each said bell-cranks includes an upper arm and a lower arm, and wherein said first trim saw is rotatably mounted on said lower arm of a first bell-crank of said bell-cranks and said second trim saw is rotatably mounted on said lower arm of a second bell-crank of said bell-cranks.

22. The trimmer of claim 21 wherein a first vertical actuator of said vertical actuators is mounted to said upper arm of said first bell-crank and a second vertical actuator of said vertical actuators is mounted to said upper arm of said second bell-crank.

23. The trimmer of claim 20 wherein said lateral actuator includes two actuators, each operably coupled with a corresponding trim saw of said first and said second trim saws such that said first and said, second trim saws may be independently selectively laterally translated on said lateral translation means.

24. The trimmer of claim 20 further comprising:

no more than a second pair of trim saws mounted in a parallel spaced apart orientation on said lateral translation means at a second end of the trimmer opposite said first end, said second pair of trim saws laterally translatable on said lateral translation means substantially parallel to said longitudinal axis of the workpiece; and a second pair of vertical actuators for selectively vertically independently displacing each trim saw of said second pair of trim saws between a raised position out of said workpiece flow path and a lowered position in said workpiece flow path;

a selectively actuable second lateral actuator cooperating with said lateral translation means for laterally translating said second pair of trim saws reciprocally and concurrently laterally across a workpiece flow path such that a lateral translation distance of said second pair of trim saws is minimized when positioning a first trim saw or a second trim saw of said second pair of trim saws for trimming the workpiece.

25. The trimmer of claim 24 wherein said lateral translation means includes a laterally oriented horizontal second shaft, and said second pair of trim saws are mounted on said second shaft.

26. The trimmer of claim 20 further comprising:

no more than a second pair of trim saws mounted in a parallel spaced apart orientation on said lateral translation means at a second end of the trimmer opposite said first end, said second pair of trim saws laterally translatable on said lateral translation means substantially parallel to said longitudinal axis of the workpiece; and a second pair of vertical actuators for selectively vertically independently displacing each trim saw of said second pair of trim saws between a raised position out of said workpiece flow path and a lowered position in said workpiece flow path;

a selectively actuable second lateral actuator cooperating with said lateral translation means for laterally translating said second pair of trim saws reciprocally and concurrently laterally across a workpiece flow path such that a lateral translation distance of said second pair of trim saws is minimized when positioning a second trim saw or a second trim saw of said second pair of trim saws for trimming the workpiece.

27. The trimmer of claim 26 wherein said lateral translation means includes a laterally oriented horizontal second shaft, and said second pair of trim saws are mounted on said second shaft.

* * * * *

UNITED STATES PATENT AND TRADEMARK OFFICE

CERTIFICATE OF CORRECTION

PATENT NO. : 7,703,365 B2
APPLICATION NO. : 11/030052
DATED : April 27, 2010
INVENTOR(S) : Geoff Wight, Ken Kantymir and Deane Henderson It is certified that error appears in the above-identified patent and that said Letters Patent is hereby corrected as shown below:

Column 6
Line 63, "...The trimmer of claim 1..." should read --...The trimmer of claim 9....--.

Column 7
Line 23, "...The trimmer of claim 1..." should read --...The trimmer of claim 9....--.

Signed and Sealed this
Second Day of August, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,703,365 B2
APPLICATION NO. : 11/030052
DATED : April 27, 2010
INVENTOR(S) : Geoff Wight, Ken Kantymir and Deane Henderson It is certified that error appears in the above-identified patent and that said Letters Patent is hereby corrected as shown below:

Column 6
Line 5, "...The trimmer of claim 1 ..." should read --...The trimmer of claim 3....--.
Line 22, "...when positioning a second trim saw ..." should read --... when positioning a first trim saw....--.

Column 7
Line 65, "...when positioning a second trim saw ..." should read --... when positioning a first trim saw....--.

Column 10
Line 1, "...The trimmer of claim 20 ..." should read --...The trimmer of claim 22....--.
Line 18, "...when positioning a second trim saw ..." should read --... when positioning a first trim saw....--.

Signed and Sealed this
Sixteenth Day of October, 2012

David J. Kappos

David J. Kappos
*Director of the United States Patent and Trademark Office*